United States Patent [19]

Bolli

[11] 4,073,125

[45] Feb. 14, 1978

[54] DRIVE MECHANISMS OF SPINNING OR TWISTING MACHINES ADAPTED FOR THE FORMATION OF KNOP YARN

[76] Inventor: Giuseppe Bolli, Campore di Vallemosso (Vercelli), Italy

[21] Appl. No.: 761,032

[22] Filed: Jan. 21, 1977

[30] Foreign Application Priority Data

Feb. 13, 1976 Italy ..... 67330/76

[51] Int. Cl.[2] ..... D01H 5/36

[52] U.S. Cl. ..... 57/38.3; 57/34 R; 19/237

[58] Field of Search ..... 57/34 R, 36, 38.3; 19/236, 237, 242

[56] References Cited

U.S. PATENT DOCUMENTS

| | | | |
|---|---|---|---|
| 2,810,165 | 10/1957 | Dunn et al. | 57/38.3 X |
| 2,811,011 | 10/1957 | McCallough | 57/38.3 |
| 3,407,589 | 10/1968 | Hasegawa | 19/237 X |
| 3,449,899 | 6/1969 | Cureton et al. | 57/38.3 |

FOREIGN PATENT DOCUMENTS

| | | | |
|---|---|---|---|
| 36,253 | 10/1971 | Japan | 19/237 |

*Primary Examiner*—Donald Watkins

*Attorney, Agent, or Firm*—Sughrue, Rothwell, Mion, Zinn and Macpeak

[57] ABSTRACT

A spinning or twisting machine is adapted for the formation of knop yarn by a drive mechanism for the lower yarn feed rollers of the draw frame, which includes a unidirectional clutch allowing the lower feed rollers to run at a higher speed than that imparted by the drive transmission of the machine, and a further unidirectional clutch by means of which an actuator, which may be pneumatic or electric, acts periodically upon the lower feed rollers to increase the speed of the latter for preselected times and intervals to cause the formation of knops in the yarn.

7 Claims, 9 Drawing Figures

DRIVE MECHANISMS OF SPINNING OR TWISTING MACHINES ADAPTED FOR THE FORMATION OF KNOP YARN

This invention relates to improvements in drive mechanisms of spinning or twisting machines adapted for the formation of "knops" in the yarn.

It is already known that knop yarn can be made by reducing at intervals, and for predetermined periods of time, the amount of draft exerted on the sliver by the draft mechanism situated upstream of each spindle, relative to the normal draft. This effect can be obtained using a draft mechanism comprising a draw frame having yarn feed rollers and, downstream of the feed rollers, successive pairs of draft rollers which are driven at peripheral speeds which increase from one pair to the next in the yarn feed direction.

In order to obtain this effect it is known to insert a speed change device in the transmission which drives the feed rollers of the draw frame, the speed change being controlled by a solenoid which when de-energised allows the feed rollers of the frame to rotate at speeds such as to advance the sliver which is to be drawn from the feed rollers at a speed relative to the peripheral speed of the draft rollers of the draft frame such as to ensure a normal draft. When the solenoid is energised, however, it causes an increase in the speed of rotation of the said feed rollers, such as to advance the sliver, downstream of the draft rollers at a higher speed which is close to the peripheral speed of the draft rollers.

The energisation of the solenoid is controlled by a circuit which is controlled by suitable means, for example, by a punched tape programme.

Such known systems have numerous disadvantages and limitations. Considerable strain is placed upon the speed change and the entire drive mechanism, consisting of cooperating gears, and upon the various draft mechanisms of the spinning machine due to the frequent changes of speed and the consequent high inertia forces which react on the motor which drives the spinning machine. Moreover, since only a limited number of fixed feed speeds are available, only a few varieties of knop yarns of different consistency can be made.

Furthermore the equipping of an existing spinning machine with knop-forming means as described above is not always possible, and is in any case difficult.

The object of the present invention is to provide a spinning or twisting machine having a drive which is adapted to form knop yarn, and which avoids the above-mentioned disadvantages while allowing a variation as desired, and by simple means, of the consistency and the length of the knops, making it possible to avoid regular repetition of a predetermined sequence of knop formation.

According to this invention there is provided a spinning or twisting machine adapted to form knops in a yarn, the machine having a drive transmission for driving lower feed rollers of a draw frame, characterised in that the drive transmission of the machine includes a first free-wheel (unidirectional) clutch which permits increase in the rotational speed of said lower feed rollers relative to the speed imparted to them by the drive transmission, said lower, driven, feed rollers of the drawing frame being connected with the interposition of a second free-wheel (unidirectional) clutch to actuator means separate from the rotary drive of the machine, adapted to increase, at preselected times and for predetermined intervals, the speed of the said lower feed rollers relative to their normal running speed, so as to form knops in the yarn at intervals.

By utilising separate actuator means to superimpose, in effect, a speed variation on the feed rollers of the draw frame speed changes in the rotary drive of the machine as a whole are avoided, and consequently less strain is placed upon the drive transmission than in the previously known systems referred to above.

In a preferred embodiment of the invention, one of the lower feed rollers has a driven shaft on which a radial arm is mounted with the interposition of the said second unidirectional clutch and the actuator means comprise a double-acting fluid pressure actuator for effecting controlled angular movement of the arm in either direction, said actuator being arranged with its axis of operation in a plane perpendicular to the axes of the feed rollers and being pivotally mounted on the machine, the operation of the actuator being controlled by a programmable control unit, and the second free-wheel clutch being arranged to allow rotation of the said arm about the axis of the said shaft in a direction contrary to the normal direction of rotation imparted to the said shaft by the drive transmission of the machine. The distributor valve may be solenoid-operated and controlled by electrical signals from the control unit.

In a preferred embodiment of the invention the control unit is controlled by electrical signals derived photoelectrically from an apertured strip film or tape provided with holes to predetermine a programmed sequence of operation of the distributor valve.

The invention will be further described, by way of non-limiting example, with reference to the accompanying drawings, in which.

Throughout the drawings the same reference numerals are used to designate the same or corresponding component parts.

Figure 1:
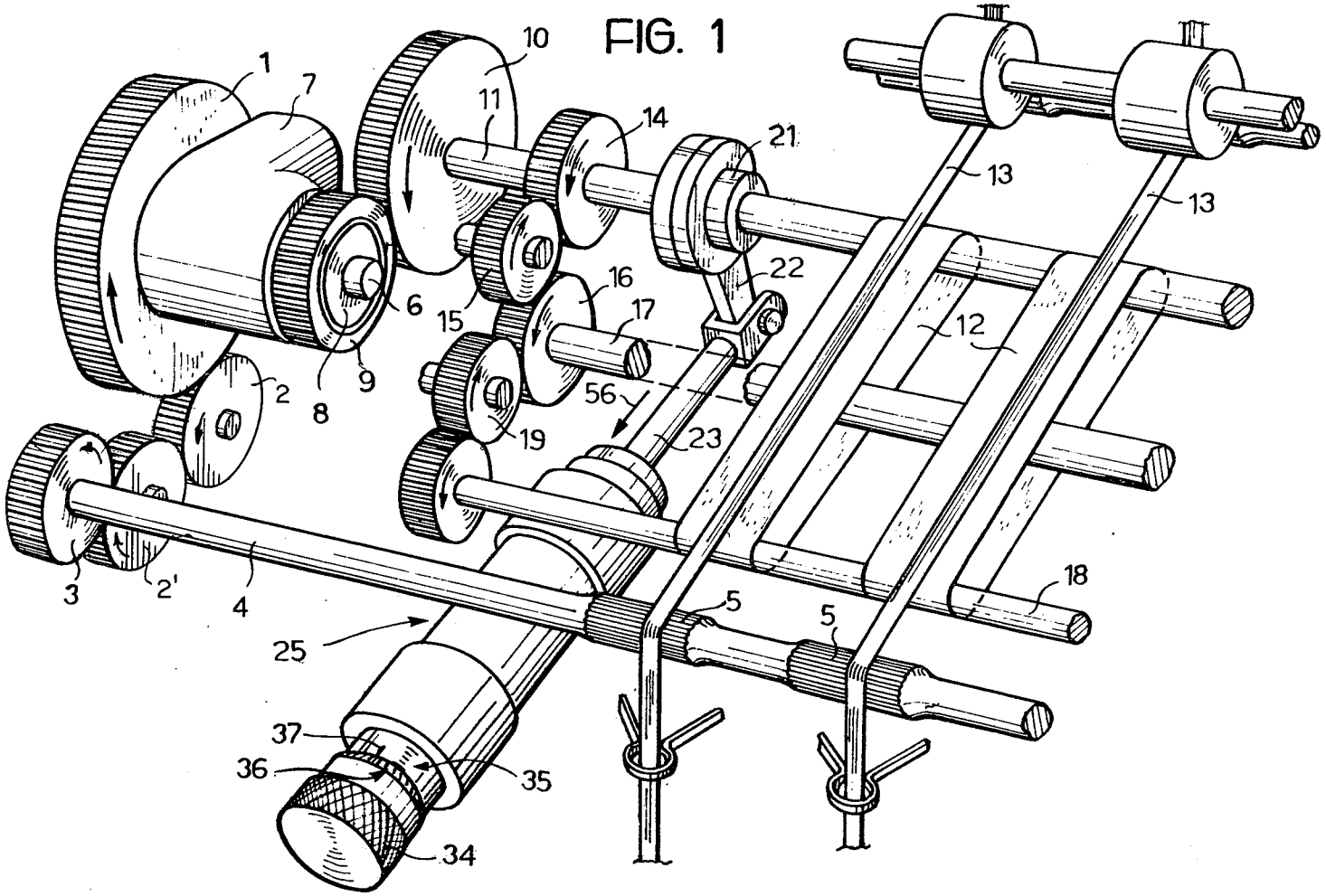
FIG. 1 is a diagrammatic perspective view of a part of the draft mechanism of a spinning machine, for example, a ring spinning machine, and of an associated drive mechanism in accordance with one embodiment of the invention for the formation of knop yarn.

Referring to the drawings, reference numeral 1 indicates a gear wheel driven from the main rotary drive transmission of a spinning machine (not shown). The gear wheel 1 transmits drive through a meshing gears 2

2′ and 3 to a shaft 4 upon which are mounted two lower draft rollers 5 of a draw frame, shown diagrammatically, situated upstream of and above the spindles (not shown) of the spinning machine. The upper presser rollers which cooperate with the rollers 5 are omitted from FIG. 1 for the sake of clarity, but are shown in broken outline in FIG 2.

The gear 1 is keyed to one end of a shaft 6 which is rotatably mounted in a fixed support 7. A gear 9 is mounted on the end of the shaft 6 opposite that which bears the gear 1, with the interposition of a first free-wheel or unidirectional clutch 8. The gear 9 transmits drive to a gear 10 keyed on to a shaft 11 parallel to the shaft 4. The shaft 11 has cylindrical portions which act as drive transmission rollers over which pass endless belts 12 which feed slivers 13 to be drawn to the lower draft rollers 5. The shaft 11 also carries a gear 14 which drives a toothed wheel 16 through an intermediate gear 15, the toothed wheel 16 being keyed to a shaft 17 which acts as an intermediate support roller for the endless belts 12. The belts 12 are driven by a shaft 18 which acts as a lower roller passing through the endless belts 12, the shaft 18 being driven through gears 19 and 20 from the toothed wheel 16.

The various gears rotate normally, in use of the drive mechanism, in the directions shown by the arrows, while the free-wheel clutch 8 is so arranged that it allows rotation of the gear 9 faster than the shaft 6.

In FIG. 1 there are omitted, for the sake of clarity, the presser rollers which press down on the belts 12 in correspondence with the shafts 11, 17 and 18. These rollers are, however, shown diagrammatically in broken outline in FIG. 2.

Figure 2:
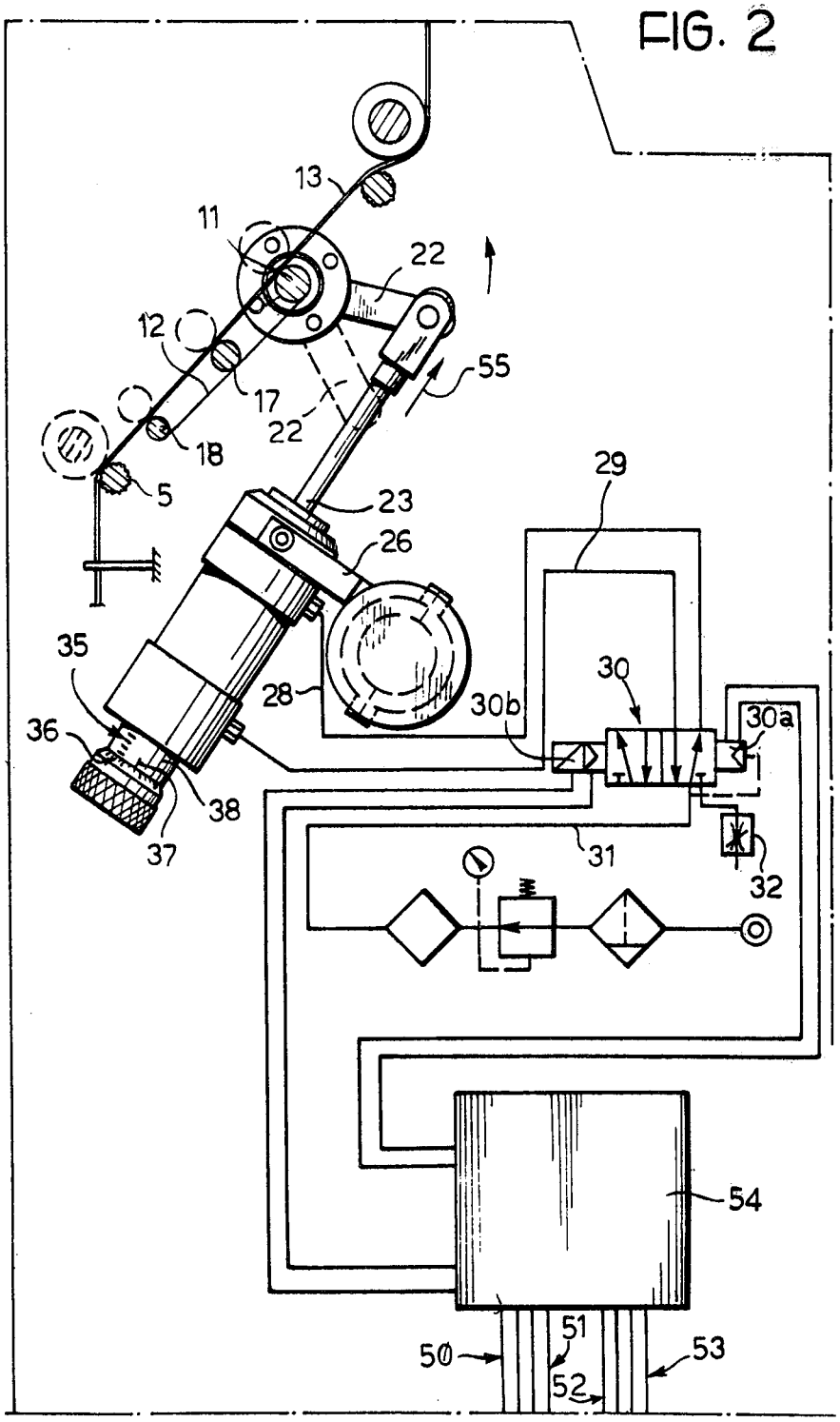
FIG. 2 shows the draft mechanism of FIG. 1 in diagrammatic cross-section.
Figure 3:
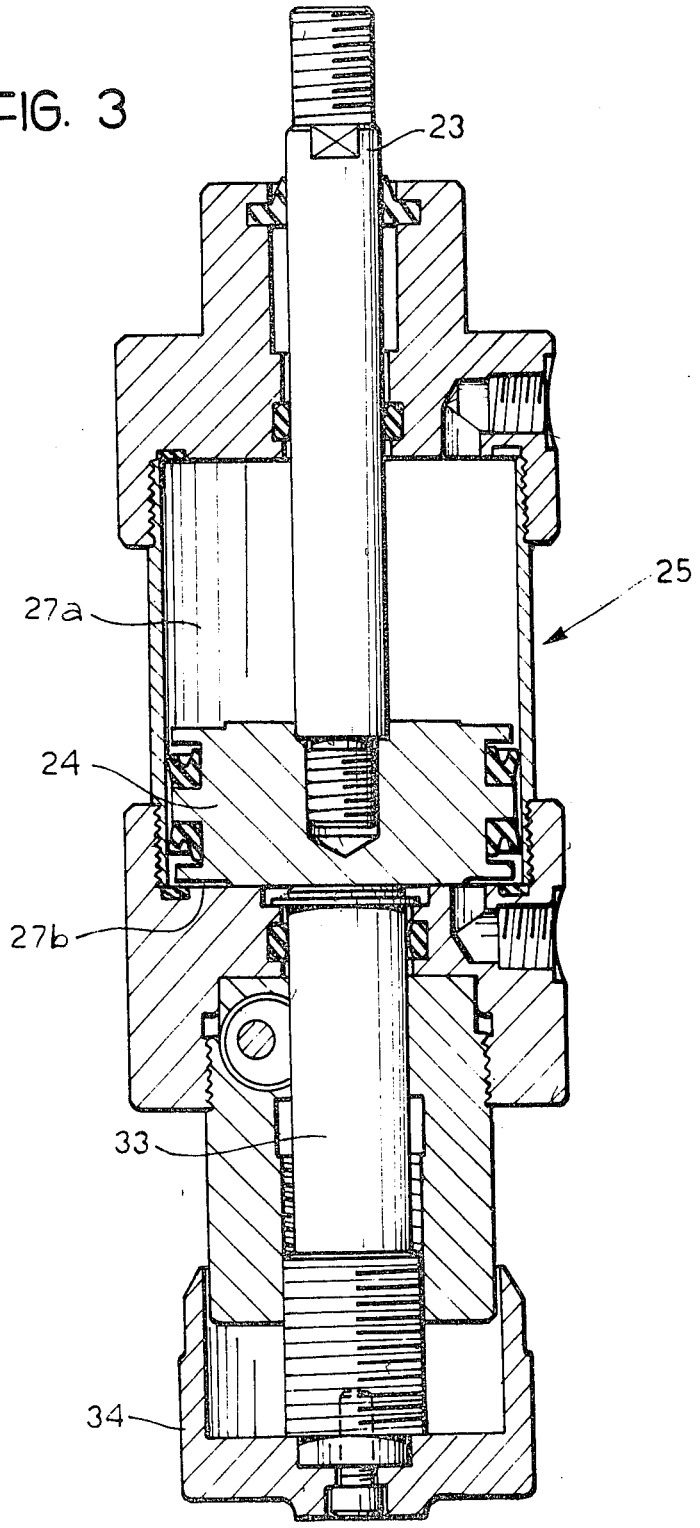
FIG. 3 is a longitudinal section, shown on an enlarged scale, of a pneumatic actuator of the mechanism illustrated in FIGS. 1 and 2.

A radial arm 22 is mounted upon the shaft 11 with the interposition of a second free-wheel or unidirectional clutch 21. The free end of the arm 22 is pivotally connected to a piston rod 23 of a piston 24 (FIG. 3) which is slidable within a pneumatic double-acting actuator cylinder 25 pivotally supported from the fixed structure of the spinning machine by means of a mounting bracket 26 (FIG. 2). The actuator cylinder 25 is pivotally supported by the bracket 26 for rotational movement about an axis parallel to the shafts 11, 17, 18 and 4. The second free-wheel clutch 21 is so arranged as to allow rotation of the shaft 11 in the direction indicated by the arrows on the gears 10 and 14 even if the radial arm 22 remains stationary.

The piston 24 subdivides the actuator cylinder 25 into two chambers 27*a* and 27*b* (FIG. 3) which are connected by the pneumatic lines 28 and 29 respectively (FIG. 2) to a solenoid-operated distributor valve 30. The distributor valve 30 has two positions, as shown diagrammatically in FIG. 2, in which one of the two chambers 27*a* and 27*b* is connected either to a source of fluid under pressure through a supply line 31 and including the usual ancillary elements, or to the atmosphere, while the other of the two chambers is connected to the atmosphere or to the supply line 31 respectively. Connection of the chamber 27*a* to the atmosphere is effected via an adjustable throttle 32 in one position of the valve 30.

The stroke of the piston 24 within the actuator cylinder 25 is limited by a stop rod 33 which projects through the end of the cylinder 25 opposite the piston rod 23. Adjustment of the stop rod 33 axially is effected by rotation of a knob 34 cooperating with a longitudinal graduation 35 on the outside of a cylindrical bush 38 which is screwed into the adjacent end of the cylinder 25 and which acts as a guide and support for the adjustable stop rod 33. In addition, for line adjustment the knob 34 bears external peripheral graduations 36 which cooperate with a fixed mark 37 on the bush 38.

Figure 4:
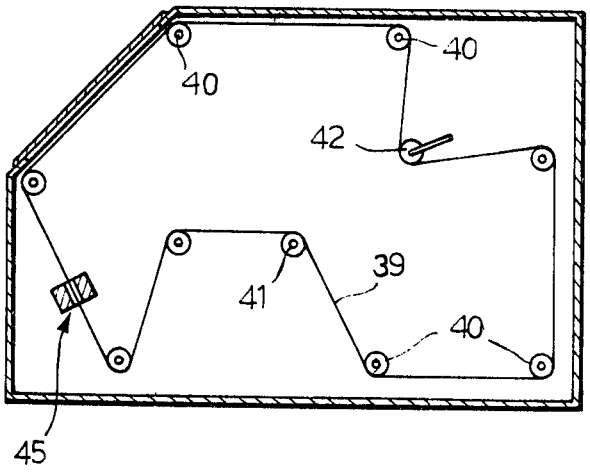
FIG. 4 is a diagrammatic longitudinal cross section of a part of a programmed control unit of the drive mechanism according to the invention.
Figure 5:
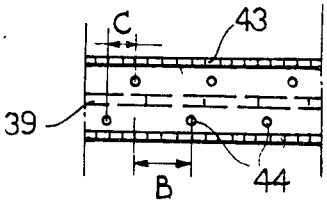
FIG. 5 is a partial front view of a programme tape associated with the drive mechanism of FIGS. 1 to 4.
Figure 7:
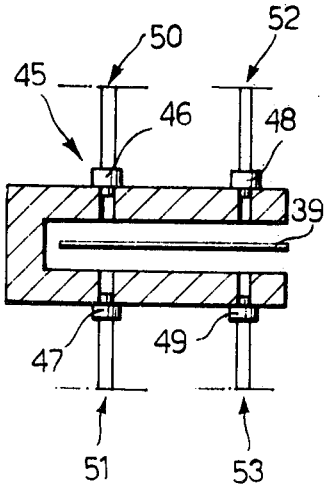
FIG. 7 is a cross section taken on the line VII—VII of FIG. 6.
Figure 6:
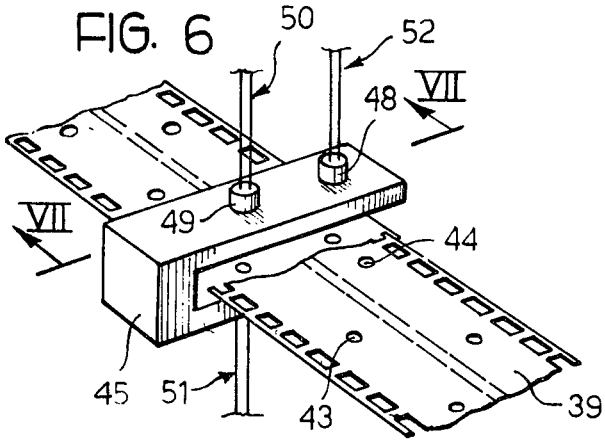
FIG. 6 is a diagrammatic perspective view, on an enlarged scale, of part of the programmed control unit shown in FIG. 4.

The operation of the distributor valve 30 is controlled by two control solenoids 30*a* and 30*b* the selective energisation of which is controlled by an electronic programmable control unit 54. Programming of the control unit 54 is effected by a programme tape 39 (FIG. 5) which passes in an endless loop over a number of guide rollers 40, the tape being driven by a drive sprocket 41 and being maintained in tension by a tensioning roller 42 carried on a swinging support (FIG. 4). The programme tape 39 in this example comprises a film having marginal perforations for engagement by the teeth of the sprocket 41 and having two series of holes, 43 and 44 respectively (FIG. 6), spaced apart at different intervals, for reasons which will be explained later. Each series of holes 43 and 44 cooperates with a respective photodiode and light source pair 46, 47 and 48, 49 (FIG. 7) mounted upon a single support 45 located in the path of movement of the tape 39. Each of the two light source pair 46, 47 and 48, 49 respectively is connected electrically via respective electrical leads 50, 51 and 52, 53 to the electronic control unit 54 which controls the energisation of the control solenoids 30*a* and 30*b* of the distributor valve 30.

The photodiode/light source pair 46, 47 is arranged in correspondence with the line of holes 43 on the programme tape 39, while the photodiode/light source pair 48, 49 is arranged in correspondence with the line of holes 44 on the said tape 39. When one of the holes 44 is between the photodiode 48 and the source 49, the photodiode 48 is illuminated by the source 49 and the resulting signal from the photodiode 48 causes the control unit 54 to energise the solenoid 30*b* thereby moving the distributor valve 30 to the position in which the chamber 27*b* of the cylinder 25 is supplied with compressed air while the chamber 27*a* is vented to atmosphere, bringing about an angular displacement of the rod 23 in the direction of the arrow 55 in FIG. 2. Given a sufficient supply pressure, such displacement of the rod 23, which causes a corresponding angular displacement of the arm 22, causes a rotational acceleration of the shafts 11, 17 and 18 sufficient for the formation of knops in the yarn. Such acceleration is rendered possible by the first free-wheel clutch 8.

When, on the other hand, one of the holes 43 is between the photodiode 46 and the source 47 of the other pair, the photodiode 46 is illuminated by the source 47 and the resulting signal from the photodiode 46 causes the control unit 54 to energise the solenoid 30*a*, moving the distributor valve 30 to the position in which the chamber 27*a* of the cylinder 25 is connected to the compressed air supply while the chamber 27*b* is vented to atmosphere. This results in displacement of the piston 24 in the direction shown by the arrow 56 in FIG. 1 and in a corresponding rotation of the arm 22: this rotation is not transmitted to the shaft 11 since the second unidirectional clutch 21 free-wheels.

By adjusting the throttle 32 (FIG. 2) it is possible to regulate the speed of the stroke of the piston 24 in the direction opposite to the arrow 55 and thereby the magnitude of the variation of the draft and the thickness of the resulting knops. By rotating the knob 34 it is possible using the graduations 35 and 36, to adjust with precision the axial position of the stop rod 33 and thereby, other conditions being equal, the length of stroke of the piston 24 and of its rod 23 which in turn determines the length of the resultant knops in the yarn. The speed of the piston 24 will also depend upon the operating pneumatic pressure, which can also be regulated.

The system according to the invention is therefore highly versatile, its versatility being moreover easily achieved using simple, inexpensive, robust and reliable means.

The chief advantage of the system herein described resides in the fact that the position of the support 45 relative to the programme tape 39 can easily be varied from time to time, thereby avoiding regular repetition of the same sequences of the knops on the yarns, which, as stated earlier, would have an undesirable effect on the appearance of fabric made with the knop yarn. Such variation may be effected by the use of two timers, the first of which determines periodically recurring instants at which the motor (not shown) which drives the sprocket 41 slows down for a short period, the duration of this short period being determined by the second timer.

Figure 8:
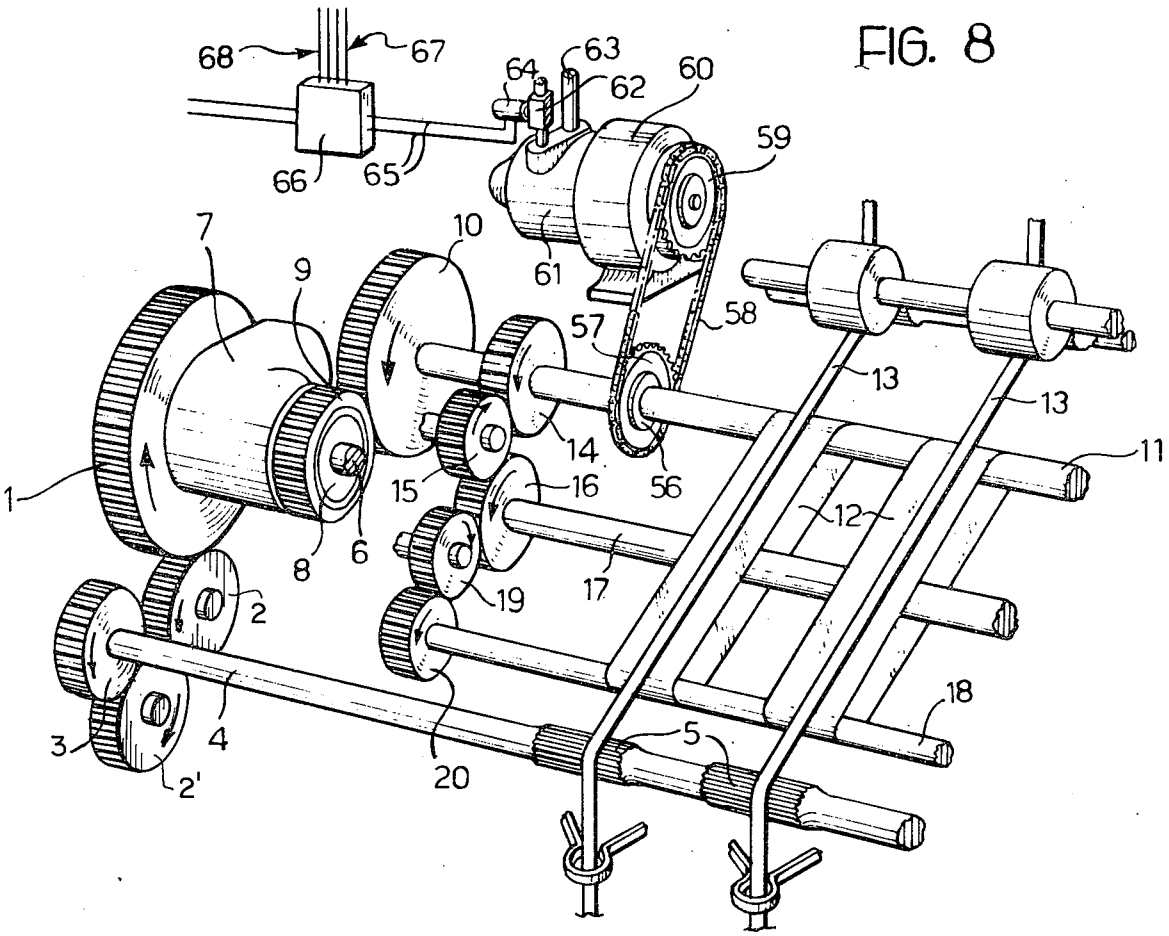
FIG. 8 is a diagrammatic perspective view of a first variant of the embodiment of the invention illustrated in FIG. 1.

In the variant illustrated in FIG. 8, a sprocket wheel 57 is mounted upon the shaft 11, through the interposition of the second free-wheel (unidirectional) clutch 56. An endless chain 58 passes over the sprocket wheel 57 and engages a sprocket wheel 59, located at a certain distance from the shaft 11, which in turn is driven by a rotary pneumatic motor 61 through a speed reduction unit 60. The motor 61 has an inlet 62 and outlet 63 respectively for the compressed air which drives the motor 61, the inlet 62 being connected to a solenoid valve 64, the opening and closing of which controls the operation of the motor 61. The solenoid valve 64 may alternatively be connected to the outlet 63, and either the inlet 62 or the outlet 63, or both the inlet and outlet, may include adjustable flow restricting throttles for the purpose of varying the speed of the motor 61.

A suitable pneumatic motor for use as the motor 61 is the model 4AM pneumatic motor manufactured by the Gast Manufacturing Corporation of the U.S.A.

The solenoid of the solenoid valve 64 is connected by electrical leads 65 to an electronic control unit 66 similar to the control unit 54 of FIG. 2. The control unit 66 is in turn connected by means of electrical leads 67 and 68 to a device (not illustrated in FIG. 8) which differs from that illustrated in FIGS. 5 and 7 in having only one photodiode/light source pair, and in that the tape passing between the photodiode and light source of the said pair has one single longitudinal row of holes cooperating with said pair, the holes being arranged at equal or unequal intervals and having various lengths in the direction of advance of the tape. This control system would be arranged as described with reference to FIG. 4 and its operation will not be described in detail as it will be apparent to those skilled in the art. It may be arranged that when solid tape is located between the photodiode and light source of the said pair, the motor 61 remains inactive, while when an aperture in the tape is located between the photodiode and the light source the motor 61 is energised and causes knops to be formed in the yarn as described earlier.

Figure 9:
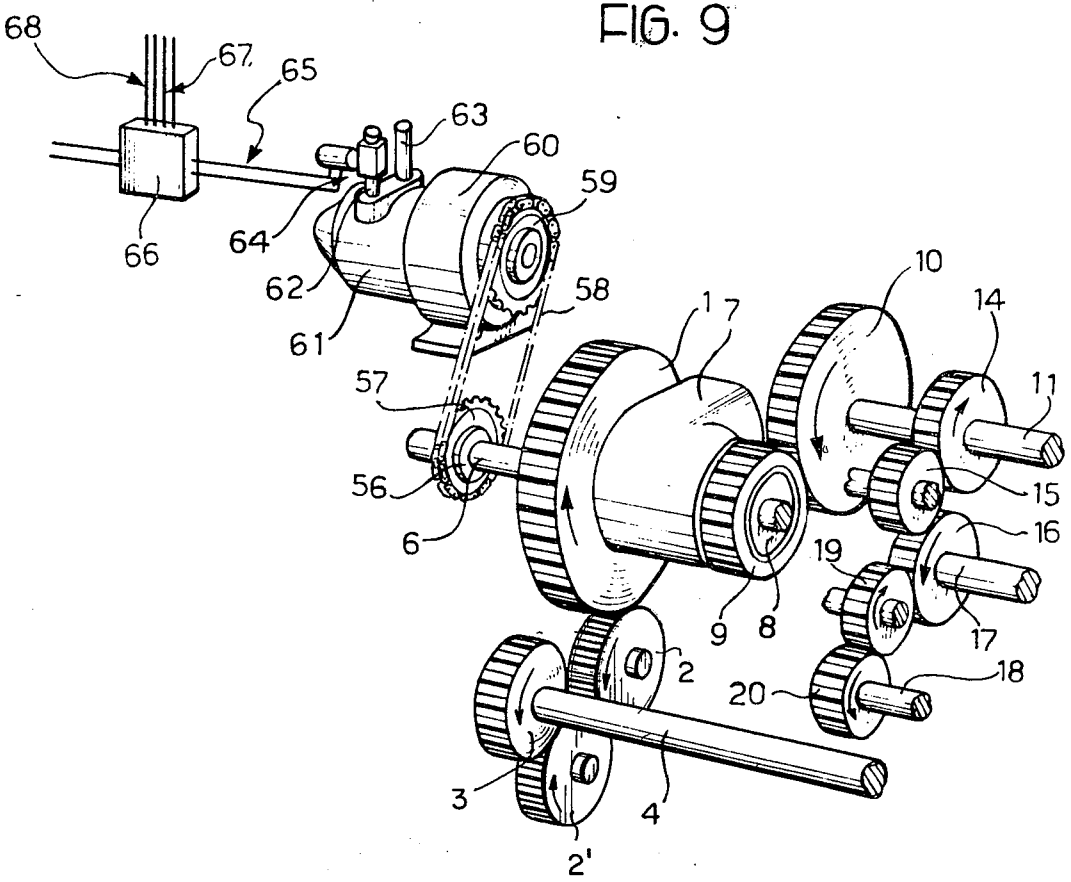
FIG. 9 is an analagous perspective view illustrating another variant of the embodiment of the invention shown in FIG. 1.

The variant illustrated in FIG. 9 differs from that of FIG. 8 in the fact that the pneumatic motor 61 drives, through the transmission elements 60, 59, 58, 57 and the unidirectional clutch 56, not the shaft 11, but the shaft 6, and in the fact that the gear 1, rather than the gear 9, is mounted upon the shaft 6 through the interposition of the first unidirectional clutch 8 while the gear 9 is keyed directly to the shaft 6. Such an arrangement is more convenient in practice for the application of the invention to certain types of spinning machines.

In the embodiments of FIGS. 8 and 9 the rotary pneumatic motor 61 may be replaced by a rotary electric motor.

I claim:

1. In a spinning machine adapted for the formation of knop yarn and having a draw frame provided with lower yarn feed rollers, and a drive transmission for driving said feed rollers, a drive mechanism including:

a first unidirectional clutch connected to the lower yarn feed rollers and arranged to permit rotation of said rollers in the yarn feed direction at a higher speed than that imparted to said rollers by the drive transmission;

actuator means separate from the drive transmission;

a second unidirectional clutch connecting said actuator means to said lower feed rollers and arranged to permit increase in the speed of said lower feed rollers relative to their normal running speed upon operation of the actuator means, and control means for effecting operation of the actuator means at predetermined times and for predetermined intervals to cause the formation of knops at intervals in yarn fed through the drawing frame in use of the machine.

2. Drive mechanism as in claim 1, wherein one of the lower feed rollers of the drawing frame has a shaft and the actuator means comprise a double-acting fluid pressure actuator and a radial arm connected to said actuator and mounted upon said shaft through the interposition of the second unidirectional clutch, said radial arm being movable angularly in either direction by means of the actuator, said actuator being pivotally mounted on the machine and arranged with its axis of operation in a plane perpendicular to the axes of the feed rollers, and said second unidirectional clutch being arranged to allow angular movement of the radial arm about the axis of the shaft in a direction contrary to the normal direction of rotation imparted to the shaft by the drive transmission.

3. Drive mechanism as in claim 2, including a solenoid-operated distributor valve connected to said actuator to control the operation thereof in both directions, said distributor valve being connected electrically to the control means which are adapted to control the operation of the distributor valve according to a predetermined program.

4. Drive mechanism as in claim 3, wherein the control means include photo-electric sensing means and an apertured tape cooperating with said sensing means and movable relative thereto, the apertures in the tape conforming to the program, and electrical signals from the photo-electric sensing means piloting operation of the distributor valve under control of the control means.

5. Drive mechanism as in claim 1, wherein the actuator means comprise a rotary pneumatic motor.

6. Drive mechanism as in claim 5, including a speed reduction unit interposed between the rotary motor and the second unidirectional clutch.

7. Drive mechanism as in claim 1, wherein the drive transmission driving the feed rollers includes a driving gear in which the first unidirectional clutch is incorporated, and wherein the second unidirectional clutch is connected to said drive transmission downstream of said driving gear.

* * * * *